US011849890B2

(12) United States Patent
Barrow

(10) Patent No.: US 11,849,890 B2
(45) Date of Patent: Dec. 26, 2023

(54) SYSTEM AND METHOD FOR MECHANICAL BATH MAT

(71) Applicant: Tyrone D. Barrow, Mililani, HI (US)

(72) Inventor: Tyrone D. Barrow, Mililani, HI (US)

( * ) Notice: Subject to any disclaimer, the term of this patent is extended or adjusted under 35 U.S.C. 154(b) by 0 days.

(21) Appl. No.: 17/373,328

(22) Filed: Jul. 12, 2021

(65) Prior Publication Data

US 2023/0009248 A1 Jan. 12, 2023

(51) Int. Cl.
*A47K 3/00* (2006.01)

(52) U.S. Cl.
CPC ..... *A47K 3/002* (2013.01)

(58) Field of Classification Search
CPC ..... A47K 3/001; A47K 3/002; A47K 3/40; A61G 13/102; E03F 5/0407; E03F 5/04; E03F 2005/0413; A01K 1/0151; Y10T 137/5762; E03C 11/229
USPC ..... 4/251.1, 559, 581, 583, 612, 541.4; 248/405; 254/100; 211/105.4; 137/362
See application file for complete search history.

(56) References Cited

U.S. PATENT DOCUMENTS 264,047 A * 9/1882 Stoner ..... A47C 3/24 4/594
510,869 A * 12/1893 Dellar ..... A47K 17/00 4/661
1,501,739 A * 7/1924 Benedek ..... A47G 27/0225 4/661
2,503,174 A * 4/1950 Salvadore ..... A47G 27/0225 4/661
2,544,780 A * 3/1951 Dean ..... B66F 3/08 248/354.3
3,013,575 A * 12/1961 Persson ..... B67D 7/007 417/479
3,222,030 A * 12/1965 Thorpe ..... E04F 15/02452 254/133 R
4,632,356 A * 12/1986 Munz ..... F16F 1/3615 248/638
5,206,963 A * 5/1993 Wiens ..... E03C 1/00 4/597
5,452,739 A * 9/1995 Mustee ..... A47L 15/4212 137/312
5,575,034 A * 11/1996 Biernacinski ..... A47K 7/026 15/161

(Continued)

FOREIGN PATENT DOCUMENTS

GB 2466667 A 7/2010
WO 2008086563 A1 7/2008
WO WO-2010005372 A1 * 1/2010 ..... E03C 1/12

*Primary Examiner* — David P Angwin
*Assistant Examiner* — William R Klotz
(74) *Attorney, Agent, or Firm* — Bold IP, PLLC; Christopher Mayle

(57) ABSTRACT

A system and method for a mechanical shower mat with a removable rechargeable battery-operated system with a drainage hose or a fixed system submerged into the bathroom floor that is wired directly into a power source, with a drainage hose that will drain directly into the drainage system of the shower/hot tub/bathtub allowing its users to collect the residual water from their bodies as the step out of the shower/hot tub/bathtub etc. onto the mechanical shower mat directly into a funnel system that will re-dispense this water back into the shower/hot tub/bathtub etc. or directly onto the shower's drainage system.

16 Claims, 4 Drawing Sheets

(56) References Cited

U.S. PATENT DOCUMENTS 5,978,983 A * 11/1999 Queen ..... A61H 9/00 4/677
6,102,073 A * 8/2000 Williams ..... A61M 1/84 137/602
6,173,856 B1 * 1/2001 Bierce ..... E01B 19/006 137/312
6,185,755 B1 * 2/2001 Shepherd ..... E03C 1/306 251/324
6,568,419 B1 5/2003 Robinson et al.
6,584,745 B1 * 7/2003 Johansson ..... E04B 5/48 52/480
6,775,862 B1 * 8/2004 Christensen ..... A61H 33/6068 4/584
6,941,703 B2 * 9/2005 MacLean ..... A01K 1/0103 137/312
7,316,834 B2 1/2008 Hernandez
8,163,367 B2 * 4/2012 Lee ..... A47L 23/266 428/71
8,337,694 B1 * 12/2012 Sykes ..... E04C 2/427 210/163
9,090,180 B2 7/2015 Hay
2006/0041238 A1 * 2/2006 Bowen ..... A61G 13/102 604/378
2006/0236450 A1 * 10/2006 Shanks ..... A47K 3/001 4/580
2007/0087163 A1 4/2007 Lasly
2008/0244825 A1 * 10/2008 Delmonico ..... E03C 1/2302 4/679
2009/0000022 A1 * 1/2009 Phipps ..... E03C 1/0408 4/601
2014/0165283 A1 * 6/2014 Beard, II ..... A47K 3/281 4/583
2014/0196805 A1 * 7/2014 Tanhehco ..... A61G 10/00 137/565.23
2014/0352810 A1 * 12/2014 Wedi ..... E03F 5/0408 137/362
2020/0033898 A1 * 1/2020 Shaaban ..... G01K 13/026

* cited by examiner

SYSTEM AND METHOD FOR MECHANICAL BATH MAT

FIELD OF DISCLOSURE

The overall invention relates to a receptacle that collects water and other fluids and, more particularly, a receptacle that collects fluids that have dripped from a user that has come out of a bathtub and redirects the fluids to a piping system or back into the bathtub.

BACKGROUND

After leaving the shower or bathtub, people typically carry a significant amount of water with them that then drips on the floor until the user has toweled off. Typically, people buy a shower mat to collect the water when they leave the bathtub but these mats are made of fabric and eventually become dirty, smelly, and mildewed causing the need to purchase another one. Thus exists the need for a mat for showers, bathtubs, hot tubs, wash sinks, etc. that could be installed that would last a lifetime while being eco-friendly.

SUMMARY

The present invention is directed to embodiments including a bath mat, including a basin for holding one or more fluids, a grate with one or more drainage holes, the basin receiving the one or more fluids by the grate, whereby the basin has a four ended inclined grading inclined towards a drainage hole in a center of the basin that channels the one or more fluids, further including a pump that receives the one or more fluids from the drainage hole, one or more tubes connected to the pump at a first end, the one or more tubes having a second end positioned in a bathtub or one or more tubes connected to a housing pipe or tubing, one or more sensors to detect when the one or more fluids needs to be removed from the basin, a control system that receives data from the one or more sensors and opens or closes a valve positioned at a bottom of the basin in response to a liquid level of the one or more fluids in the basin, a mesh layer positioned above the grate, a removable rubber pad positioned above the mesh layer, a rubber lining on an exterior of the grate, one or more support columns positioned between the basin and the grate, whereby the one or more support columns are made of an upper component and lower component that are screwed into one another with one or more rubber seals positioned between the upper component and the lower component.

The present invention is directed to further embodiments including a bath mat, a basin for holding one or more fluids, a grate with one or more drainage holes, the basin receiving the one or more fluids by the grate, whereby a rubber lining is on an exterior of the grate, a mesh layer positioned above the grate, and a removable rubber pad positioned above the mesh layer, whereby the basin has a four ended inclined grading inclined towards a drainage hole in a center of the basin that channels the one or more fluids, further including a pump that receives the one or more fluids from the drainage hole, one or more tubes connected to the pump at a first end, the one or more tubes having a second end positioned in a bathtub, one or more tubes connected a housing pipe or tubing, one or more sensors to detect when the one or more fluids needs to be removed from the basin, a control system that receives data from the one or more sensors and opens or closes a valve positioned at a bottom of the basin in response to a liquid level of the one or more fluids in the basin, and one or more support columns positioned between the basin and the grate, whereby the one or more support columns are made of an upper component and lower component that are screwed into one another with one or more rubber seals positioned between the upper component and the lower component.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figures 1A, 1B:
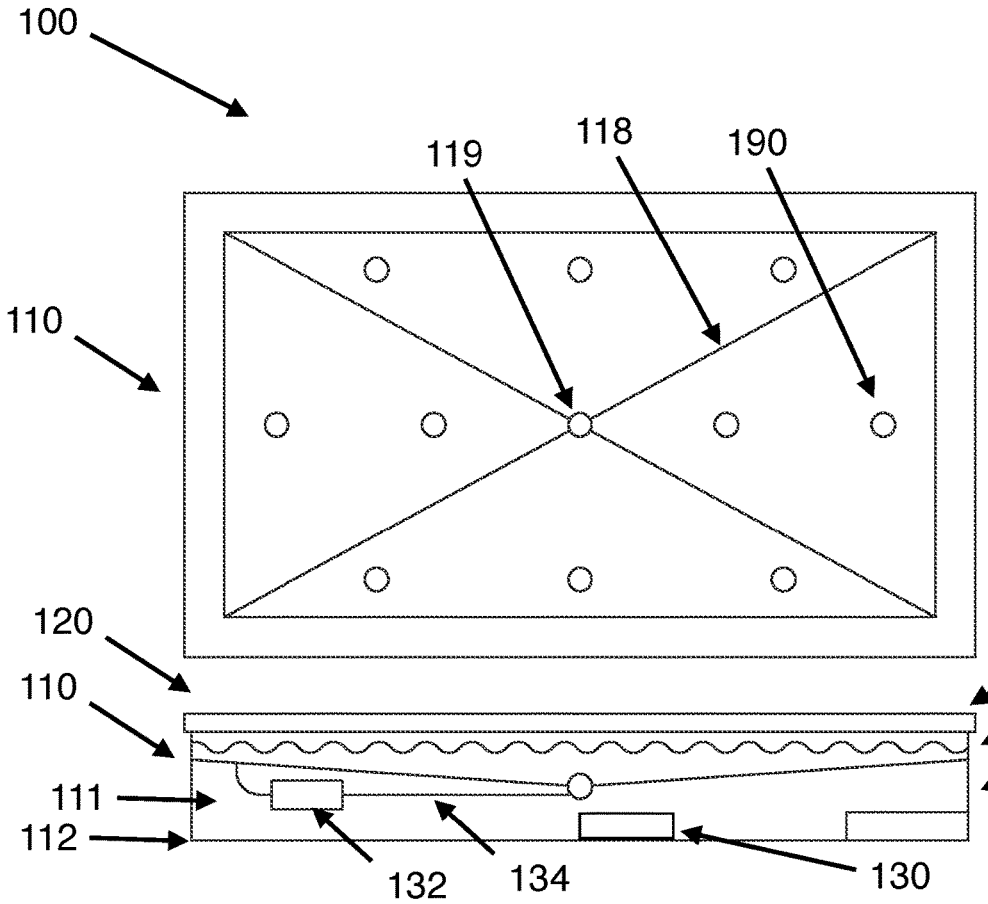
FIG. 1A-1B show an embodiment of the mechanical bath mat.
Figure 2A:
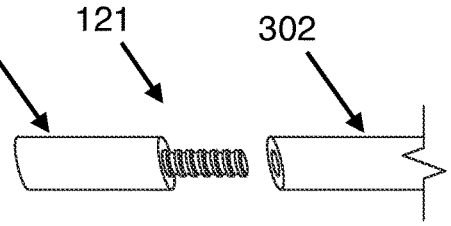
FIG. 2A-2B show an embodiment of the support poles for the mechanical bath mat.
Figure 2B:
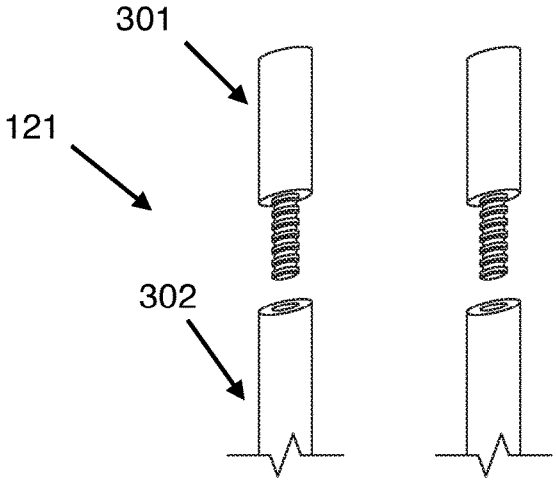
Figure 3A:
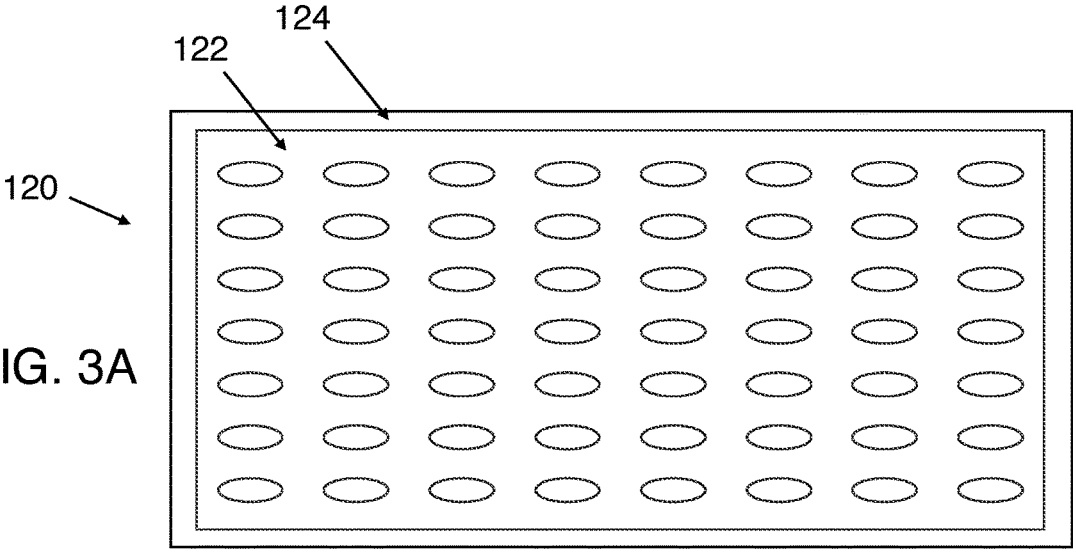
FIG. 3A-3B show an embodiment of the metal and rubber grate.
Figure 3B:
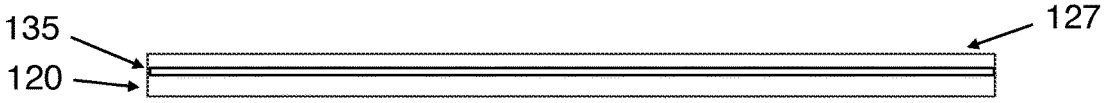
Figure 4A:
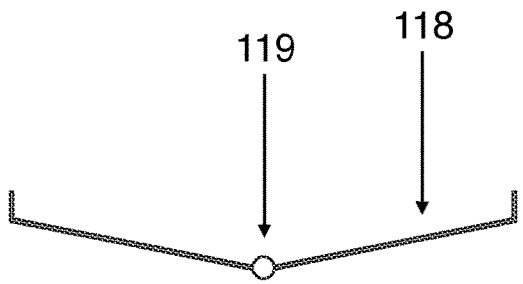
FIG. 4A-4B show an embodiment of the grading.
Figure 4B:
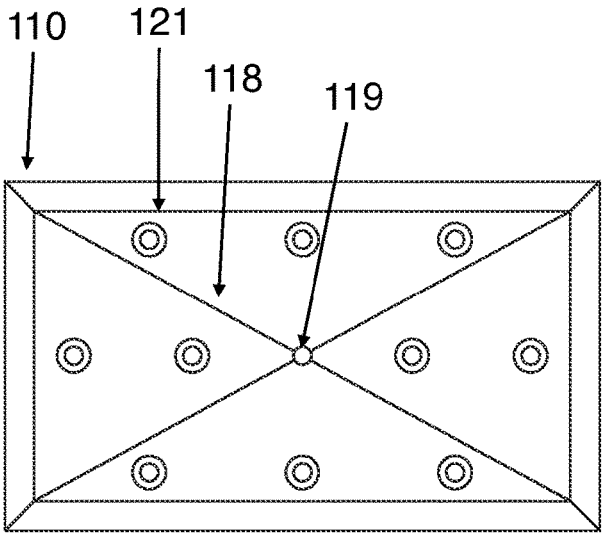
Figure 5:
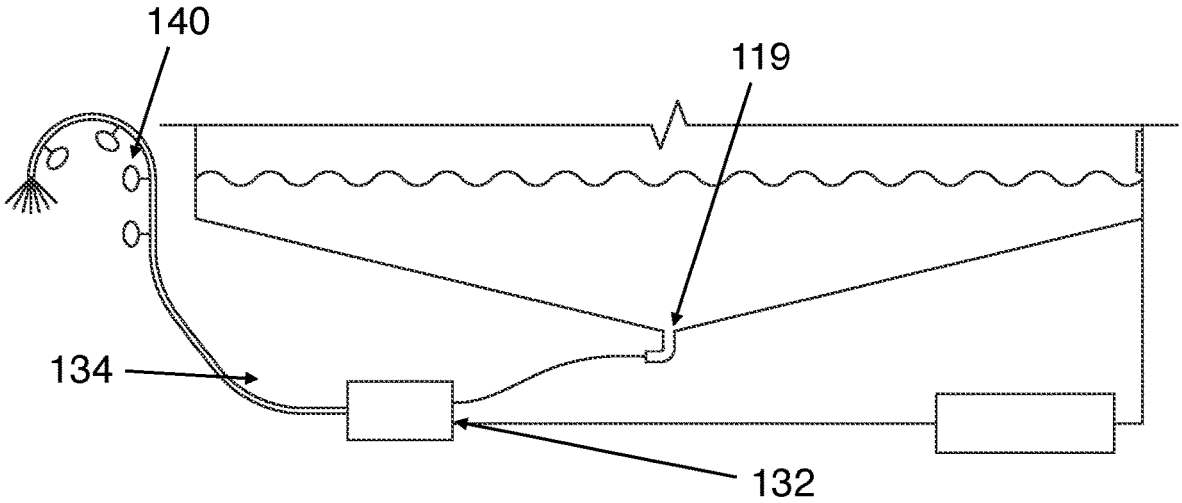
FIG. 5 show an embodiment of the mechanical bath mat that drains into a collection device.
Figure 6:
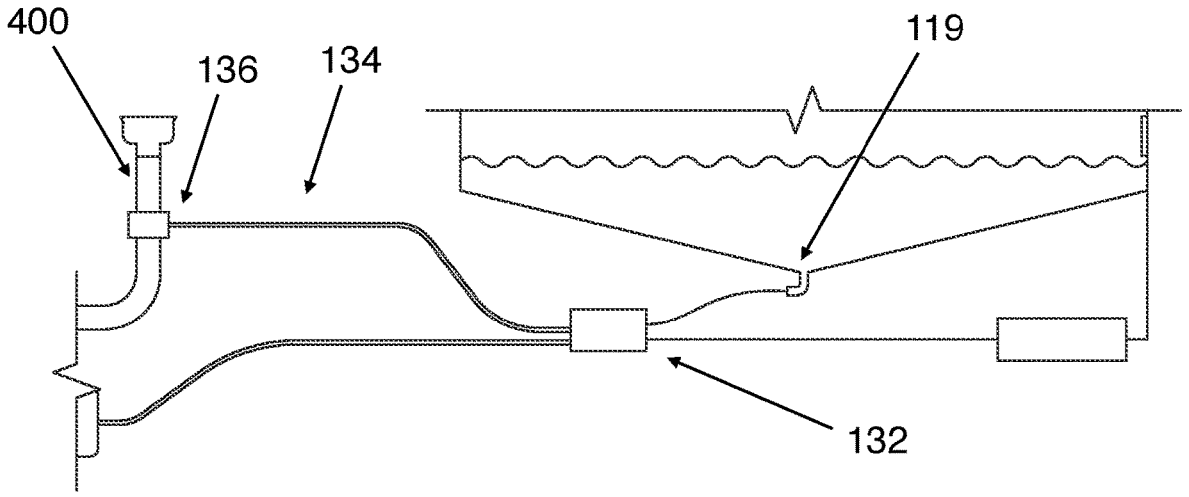
FIG. 6 show an embodiment of the mechanical bath mat integrated into a drainage system.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items" may indicate the presence of only one item or may indicate more items. Thus, the term "set" may be equivalent to "one or more" as used herein.

The present disclosure recognizes the unsolved need for a mechanical shower mat that will replace conventional shower mats made of fibers. The mechanical shower mat has two designs: (1) a removable rechargeable battery-operated system with a drainage hose as well as (2) a fixed system submerged into the bathroom floor that is wired directly into a power source with a back-up rechargeable battery and a drainage hose that will drain directly into the drainage system of the shower/hot tub/bathtub etc. These embodiments of the mechanical shower mat will allow its users to collect the residual water from their bodies as they step out of the shower/hot tub/bathtub etc. onto the mechanical shower mat directly into a funnel system that will re-dispense this water back into the shower/hot tub/bathtub etc. or directly onto the shower's drainage system.

FIG. 1 is a perspective view of an embodiment of mechanical bath mat 100 of the present invention. Mechanical bath mat 100 may have one or more power systems that provide power to various components and the circuits and components of a control system. In some embodiments, mechanical bath mat 100 may plug into an electrical outlet using an electrical cord to supply power. Further the power system may include a discardable or rechargeable battery pack whereby the rechargeable battery is of a charge, design, and capacity, to provide sufficient power to power the components of mechanical bath mat 100.

The control system may operate to control the actuation of the other systems. The control system may have a series of computing devices. The control system may be in the form of a circuit board, a memory, or other non-transient storage medium in which computer-readable coded instructions are stored and one or more processors configured to execute the instructions stored in the memory. The control system may have a wireless transmitter, a wireless receiver, and a related computer process executing on the processors.

Computing devices of the control system may be any type of computing device that typically operates under the control of one or more operating systems which control scheduling of tasks and access to system resources. Computing devices may be a phone, tablet, television, desktop computer, laptop computer, gaming system, wearable device electronic glasses, networked router, networked switch, networked bridge, or any computing device capable of executing instructions with sufficient processor power and memory capacity to perform operations of the control system.

The one or more computing devices may be integrated into the control system, while in other non-limiting embodiments, the control system may be a remotely located computing device or server configured to communicate with one or more other control systems. The control system may also include an internet connection, network connection, and/or other wired or wireless means of communication (e.g., LAN, etc.) to interact with other components. The connection allows a user to update, control, send/retrieve information, monitor, or otherwise interact passively or actively with the control system.

The control system may include control circuitry and one or more microprocessors or controllers acting as a servo control mechanism capable of receiving input from sensors and other components analyzing the input from sensors and other components, and generating an output signal to components. The microprocessors (not shown) may have on-board memory to control the power that is applied to the various systems. The control system may include circuitry to provide an actuable interface for a user to interact with, including switches and indicators and accompanying circuitry for an electronic control panel or mechanical control panel. The control system may be preprogrammed with any reference values by any combination of hardwiring, software, or firmware to implement various operational modes including but not limited to temperature, light, and humidity values.

The microprocessors in the control system may also monitor the current state of circuitry within the control system to determine the specific mode of operation chosen by the user. For instance, when "on," the microprocessors may begin recirculating water at predetermined intervals. Further, such microprocessors that may be part of the control system may receive signals from any of or all systems. Such systems may be notified whether any of the components in the various systems need to be replaced.

Mechanical bath mat 100 may have a basin 110 positioned below a metal and rubber grate 120, which may be positioned below a protective mesh 135 positioned below a rubber pad 127. One or more suction cups 140 may be attached to mechanical bath mat 100 or one or more tubes exiting mechanical bath mat 100 to keep mechanical bath mat maintained in relation to another apparatus such as the outside of a bathtub or other apparatus.

Basin 110 supports mechanical bath mat 100 in an upright position on a supporting surface. Basin 110 may have an inner chamber 111 or empty space that extends into basin 110 between the inner walls of basin 110 to receive fluid and hold fluid until the fluid is dispensed or applied. In some non-limiting embodiments, basin 110 may be 2½ inches deep and rectangular in shape, however, this is non limiting and basin 110 may be any suitable shape to receive fluids.

Basin 110 may have a bottom element 112 whereby when placed on a support, bottom element 112 comes into contact with the supporting surface. Basin 110 as a whole, is generally symmetric about a vertical axis passing through the middle of basin 110 perpendicular supporting surface. A sidewall portion 114 extends upward from an upper margin of bottom element 112. Sidewall portion 114 then extends upward into a top element 116. Top element 116 may have a curved lip to hold metal and rubber grate 120 as well as an aperture leading into the inner chamber 111 of basin 110 such that fluids pass into the chamber from metal and rubber grate 120.

Positioned 1½ inches below top element 116 may be a four ended grading 118 that is inclined toward a drainage hole 119 at a center of basin 110 such that fluids collected on grading 118 will then be diverted toward drainage hole 119. Drainage hole 119 is where the fluids will be collected for drainage.

Basin 110 may have one or more sensors 130 or detectors mounted or otherwise connected. Sensors 130 may include one or more suitable types of sensors, such as an optical sensor, an image capturing device such as a still camera or video camera, an audible sensor, a proximity sensor, a movement sensor, or a weight sensor. Sensors 130 may have infrared ("IR") detectors having photodiodes and related amplification and detection circuitry. In one or more other non-limiting embodiments, radio frequencies, magnetic fields, and ultrasonic sensors and transducers may be employed. Sensors 130 may have one or more digital scales capable of determining the weights and liquid level in basin 110.

Basin 110 may include or otherwise be connected to a pump 132 whereby pump 132 expels fluids from basin 110 through one or more tubes 134 or hoses that pass out of basin 110. Tubes 134 may be designed to extend outside of basin 110 and carry pressurized water pressurized by pump 132 back into a bathtub or other apparatus to collect water that has been removed from basin 110. Sensors 130 may send signals to the control system which then sends an output signal to control pump 132.

Pump 132 may be connected to one or more valves at the bottom of drainage hole 119 for containing water in basin 110. Valves may be spring-loaded, whereby when engaged or otherwise activated (e.g., such as by a motorized system receiving signals from the control system), the valve is opened, thus permitting the flow of water to pump 132. Valves may have a stopper, whereby the spring biases the stopper against movement in one direction to create a normally closed position. In one embodiment, when the control system sends a signal to the motor that is connected to the valves to open valves, a force is applied against the spring causing the spring to be depressed as well as the stopper to be activated and to move upward along with the spring. In another embodiment the valve may be opened and closed by a manual actuator and stopper. In operation, the control system may send a signal to another mechanical system for the valve to open and to allow water to be released from basin 110 to pump 132 and then flushed from basin 110.

In other non-limiting embodiments, pump 132 may be connected to a tube 134 acting in place of the valves provided for water to pass through. An opening/closing mechanism may be disposed within the hose connected to the control system, whereby an opening/closing mechanism opens or closes the passage in order to dose a predetermined or registerable amount of water down from drainage hole 119. The passage may be opened or closed by the opening/closing mechanism clinching the flexible hose to prevent water from passing through and releasing the flexible hose to allow the water to pass through.

In other non-limiting embodiments, tubes 134 may be attached to a connector piece 136. Connector piece 136 may be removably connected with a push fit or twist locking engagement or be connected by any number of fasteners such as hinges, latches, buckles, or adhesive. Connector piece 136 may be coupled to a drain, outlet, piping, or tubing such as drain 400. For instance, connector piece 136 may be connected to an existing housing piping system or shower drain. In this configuration, an existing pipe may be retrofitted with a shower drain sleeve whereby connector piece 136 or tubing attached to connector piece 136 may be connected to the shower drain sleeve whereby tubes 134 are provided access to the drain through the drain sleeve. This allows fluids to exit from the bathroom and basin 110 simultaneously.

Removable metal and rubber grate 120 may be positioned on top element 116 of dimensions that will match that of basin 110. Metal and rubber grate 120 may be ¼ inches thick, however, this is non-limiting and may be any suitable thickness. Metal and rubber grate 120 may have a main metal body 122 with multiple apertures surrounded by a rubber lining 124 on the outer edges of metal body 122.

One or more support columns 121 may be positioned or mounted in one or more holes 190 of the interior chamber of basin 110 to assist with providing structural support to grading for a user standing on metal and rubber grate 120 whereby metal and rubber grate 120 will have one or more holes 190 in the grading to receive support columns 121. Support columns 121 may be made of an upper component 301 and lower component 302 and that are screwed into one another with one or more rubber seals positioned between the upper component 301 and lower component 302.

Metal and rubber grate 120 may be covered with protective mesh 135, for keeping debris or anything that might clog components mechanical bath mat 100 and filling in area caused by the shape of metal and rubber grate 120. A removable rubber pad 127, which sits over a protective mesh 135 metal portion, can be interchangeable and can be made to match, paint, patterns, curtains, tiles etc. designed to provide customizable options to mechanical bath mat 100 as well as provide a non-slippage surface for mechanical bath mat 100.

The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A bath mat, comprising:

a basin for holding one or more fluids;

a grate with one or more grate drainage holes, the basin receiving the one or more fluids by the grate, wherein the basin has a four ended inclined grading declined towards a basin drainage hole in a center of the basin that channels the one or more fluids; and one or more support columns are each positioned through holes in the basin and extend upward to the grate, wherein the grate has receiving components to receive the one or more support columns, wherein the one or more support columns are made of an upper component attached to the grate and a lower component attached to the basin that are screwed into one another, wherein the upper component has a body and a threaded portion that is received into an aperture inside a body of the lower component such that an entire bottom of the body of the upper component rests directly on top of the body of the lower component.

2. The bath mat of claim 1, further comprising a pump that receives the one or more fluids from the basin drainage hole and a valve at a bottom of the basin that restricts or allows the one or more fluids to the pump, the valve having a stopper, wherein a spring biases the stopper against movement in one direction to create a closed position, wherein the valve is connected to a motor for opening and closing the valve.

3. The bath mat of claim 2, further comprising one or more tubes connected to the pump, the one or more tubes having an inlet connected to the basin drainage hole and an outlet positioned in a bathtub wherein the pump is configured to pump the one or more fluids from a first position to a second position at the bathtub.

4. The bath mat of claim 3, further comprising a connector piece, wherein the one or more tubes are connected to the connector piece, wherein the connector piece is coupled to an existing drainage system wherein the one or more fluids are directed from the one or more grate drainage holes to the drainage system.

5. The bath mat of claim 4, further comprising one or more proximity sensors to detect when the one or more fluids needs to be removed from the basin.

6. The bath mat of claim 5, further comprising a shower sleeve is a tube positioned over or enclosing an existing pipe, wherein the connector piece is coupled to the shower sleeve to direct water from the basin drainage hole to a shower drain.

7. The bath mat of claim 6, further comprising a mesh layer positioned above the grate.

8. The bath mat of claim 7, further comprising a remotely located computing device to open the valve to remove the one or more fluids by the pump.

9. The bath mat of claim 8, wherein the grate has a central metal portion with a surrounding rubber sleeve.

10. The bath mat of claim 9, further comprising a battery pack to power components of the bath mat and a control panel to operate as a user interface.

11. A bath mat, comprising:

a basin for holding one or more fluids;

a grate with one or more grate drainage holes, the basin receiving the one or more fluids by the grate, wherein a rubber lining is on an exterior of the grate;

a mesh layer positioned above the grate;

a removable rubber pad positioned above the mesh layer; and a plurality of support columns each positioned through holes in the basin and extend upward to the grate, wherein the plurality of support columns are received into receiving components of the grate, wherein a first set of the plurality of support columns are positioned near edges of the grate, wherein a second set of the plurality of support columns are positioned more near than the first set to the one or more grate drainage holes at a center of the grate, wherein the plurality of support columns are made of an upper component attached to the grate and a lower component attached to the basin that are screwed into one another, wherein the upper component has a body and a threaded portion that is received into an aperture inside a body of the lower component such that an entire bottom of the body of the upper component rests directly on top of the body of the lower component wherein when the upper component and the lower component are connected, the plurality of the support columns are of a consistent diameter.

12. The bath mat of claim 11, wherein the basin has inclined grading declined towards a basin drainage hole in a center of the basin that channels the one or more fluids.

13. The bath mat of claim 12, further comprising a battery pack to power components of the bath mat and a user interface for interaction.

14. The bath mat of claim 13, further comprising a connector piece, wherein the connector piece is coupled to an existing drainage system, wherein the one or more fluids are directed from the basin drainage hole to the existing drainage system through the one or more tubes, wherein the connector piece is connected to a shower sleeve is a tube positioned over or enclosing an existing pipe.

15. The bath mat of claim 14, further comprising one or more digital scales to detect when the one or more fluids needs to be removed from the basin.

16. The bath mat of claim 15, further comprising one or more suction cups connected to the bath mat.

* * * * *